US007068140B2

(12) United States Patent
Chou

(10) Patent No.: US 7,068,140 B2
(45) Date of Patent: Jun. 27, 2006

(54) COPLANAR TRANSFORMER WITH A CAPACITOR

(75) Inventor: Ya-Wei Chou, Taipei (TW)

(73) Assignee: VIA Technologies, Inc., Taipei (TW)

( * ) Notice: Subject to any disclaimer, the term of this patent is extended or adjusted under 35 U.S.C. 154(b) by 9 days.

(21) Appl. No.: 10/973,849

(22) Filed: Oct. 25, 2004

(65) Prior Publication Data

US 2005/0104706 A1 May 19, 2005

(30) Foreign Application Priority Data

Nov. 18, 2003 (TW) ..... 92132331 A

(51) Int. Cl.
*H01F 5/00* (2006.01)

(52) U.S. Cl. ..... 336/200; 336/223; 336/232

(58) Field of Classification Search ..... 336/200, 336/223, 232
See application file for complete search history.

(56) References Cited

U.S. PATENT DOCUMENTS 5,416,356 A 5/1995 Staudinger et al.
5,969,590 A * 10/1999 Gutierrez ..... 336/200
6,501,363 B1 * 12/2002 Hwu et al. ..... 336/200
6,577,217 B1 6/2003 Bournarie et al.
6,608,361 B1 * 8/2003 Chang et al. ..... 257/499
2004/0232519 A1 * 11/2004 Van Beek et al. ..... 257/531

FOREIGN PATENT DOCUMENTS

CN 1109202 A 9/1995

* cited by examiner

*Primary Examiner*—Anh Mai
(74) *Attorney, Agent, or Firm*—Squire, Sanders & Dempsey L.L.P.

(57) ABSTRACT

A coplanar transformer with a capacitor that has the advantage of high space utilization is provided. The coplanar transformer comprises a primary coil and a secondary coil constructed by many conductor segments in a first metal layer and connectors in a second metal layer. The upper plate and lower plate of the capacitor are electrically coupled with the two terminals of the primary coil separately. The upper plate comprises the extended plate from the connected terminal toward the other terminal and the connected conductor segment in the first metal layer, and the lower plate locates in the second metal layer corresponding to the upper plate.

19 Claims, 5 Drawing Sheets

COPLANAR TRANSFORMER WITH A CAPACITOR

BACKGROUND OF THE INVENTION

1. Field of the Invention

The present invention generally relates to an integrated circuit, and more particularly to a coplanar transformer with a capacitor.

2. Description of the Prior Art

The transformer is an electromagnetically coupling device using two coils of wire, from one coil an AC signal being inputted to make another coil produce a corresponding AC signal. Generally speaking, the former one is called primary coil, and the latter one is called secondary coil. The efficiency of electromagnetically coupling is the efficiency of transferring of energy from primary coil to secondary coil, in which the sensitivity of transformer to noise in whole is also contained.

The two coils in transformer are deployed as being wrapped in a core part, which can be air core or ferrite core used to improve coupling efficiency. And the deployment of coils opposite to core part are stacked, one wrapped in front and one in back, or interleaved.

The transformer in which the coils are deployed as stacked or interleaved can be used in Multi-Layer IC Circuits, in which the stacked coils being conductors of two-layer spiral structure weaved one coil up and one coil down, the interleaved coils being two coils of conductors interwoven on conductor pattern of a coplanar spiral structure, and the two having no contact with each other. High capacitance occurs when the coils are staked, meaning that the coils in one coil up and one coil down structure will be like two electrodes of capacitor. This capacitive coupling will cause phase-shifts and amplitude errors. Compared with staked coils, in transformer with coplanar interleaved coils, conductors of each coil are set next to each other rather than staked on top of each other. Therefore capacitive coupling is decreased and there will be fewer phase-shifts and amplitude errors.

FIG. 1A and FIG. 1B are diagrams that show the back of a coplanar interleaved transformer. This transformer has primary coil 110 and secondary coil 120, end point 111 and end point 112 being end points of primary coil 110 and end point 121 and end point 122 being end points of secondary coil 120. Primary coil 110 and secondary coil 120 are constituted respectively by several conductor segments 140 and connected conductors 130, all conductor segments 140 being located at a first metal layer and all connected conductors 130 being located at a second metal layer. Wherein, two ends of each connected conductor 130 are respectively electronically coupled with a conductor segment 140 for winding round a conductor segment 140 of another coil to keep primary coil 110 and secondary coil 120 interleaving on the same plane from contacting each other. Obviously, coplanar interleaved transformer and staked transformer need more square measure but can avoid capacitive coupling more efficiently.

Transformer is generally used for providing electric isolation between signals and can be used for coupling a signal with a resonant L-C circuit, making one of the coils provide inductance or part of inductance. And typical radio-frequency transmitters contain this kind of RF transformer that combines resonant antenna stage and outputting stage. As shown in FIG. 1C, when primary coil 110 is in parallel connection with a capacitor 150, compared with prior design, the transfer of energy from primary coil 110 to secondary coil 120 can be increased. Thus increase of efficiency of transfer or improvement of matching can maximize the integral yield. This becomes very important when the energy inputted from primary coil 110 is very small (for example, signal received by antenna) and the integral efficiency can therefore be improved. However, extra capacitor device means need of extra space. Concerning this coplanar interleaved transformer that has extravagant use of space in structure, if the capacitor and transformer can be combined in the same space, many costs can be saved.

SUMMARY OF THE INVENTION

One main purpose of the present invention is to provide a coplanar transformer with a capacitor that can be used at certain frequency to improve the integral efficiency of energy transformation.

Another main purpose of the present invention is to provide an improved structure of coplanar transformer, the added improved structure being located in free space in transformer and needing not to change the original structure of transformer or increase extra cost.

According to the purposes described above, the present invention provides a coplanar transformer with a capacitor. This coplanar transformer has a primary coil, a secondary coil, and a capacitor, the primary coil and secondary being constituted respectively by several conductor segments and connected conductors. The upper plate and lower plate of the capacitor are electrically coupled with the two terminals of the primary coil separately. The upper plate can be the extended plate from the coupled terminal toward the other terminal or the conductor segment connected with the terminal or combination of both. The size and position of lower plate can be corresponding to the upper plate that extends from the coupled terminal toward the other terminal or part of conductor segment that connects with the terminal coupled with upper plate or combination of both. The present invention has the merit of highly efficient use of space.

BRIEF DESCRIPTION OF THE DRAWINGS

The merits and advantages of the present invention compared with the prior art will be more easily presented by referring to the following diagrams and comparison of embodiments, in which.

DETAILED DESCRIPTION OF THE PREFERRED EMBODIMENTS

Some embodiments of the present invention will be described in detail in the following. However, beside the detailed description, the present invention can also be applied widely in other embodiments and the scope of the present invention is only limited by the appended claims.

Furthermore, in order to provide clearer description and make the present invention more easily understood, each part in the diagrams is not drawn according to relative sizes, some sizes comparing with other relative measures being exaggerated; irrelevant details are not drawn in order to keep the diagrams concise and clean.

The present invention provides a new coplanar transformer structure, which, compared with traditional coplanar transformer structure, contains a terminal capacitor that is in parallel connection with two end points of primary coil, enabling the transformer to increase the efficiency of energy transfer from primary coil to secondary coil at certain frequency. Wherein, the upper and lower plates are respectively electrically coupled with two end points of primary coil.

Therefore the present invention is a coplanar transformer, which comprises a primary coil, a secondary coil, and a terminal capacitor. Primary coil and secondary coil both comprise two end points to input or output signal. In the meantime, two end points of primary coil are respectively electrically coupled with upper plate and lower plate of capacitor. Wherein, end point of primary coil, end point of secondary coil, and upper plate are all located on a first metal layer, and lower plate is located on a second metal layer and its location is opposite location of upper plate to lower plate, meaning that upper plate and lower plate are in parallel. Besides, primary coil and secondary coil are interleaved in a plurality of interleaving sections, and other parts of primary and secondary coil become segments of conductors outside these interleaving sections. Wherein, in these interleaving sections, conductor of primary coil or secondary coil extends downward to second metal layer to wind round the conductor of the other to prevent the two coils from contacting each other.

Figure 1A:
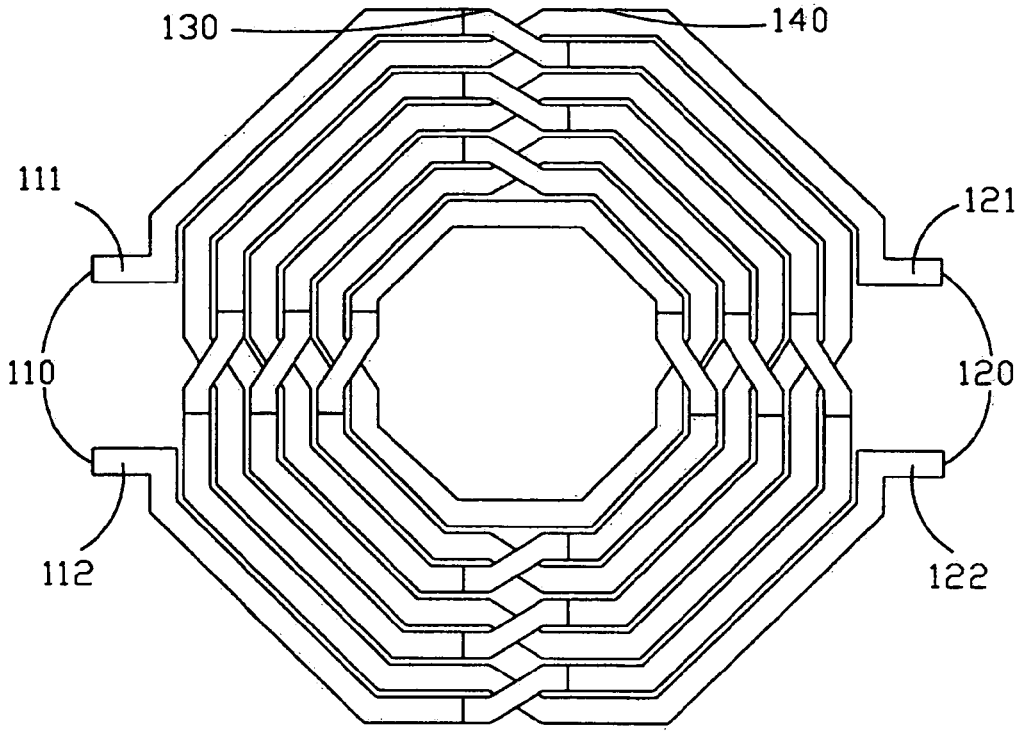
FIG.1A(Prior Art)
FIG. 1A to FIG. 1C are diagrams of prior art.
Figure 1B:
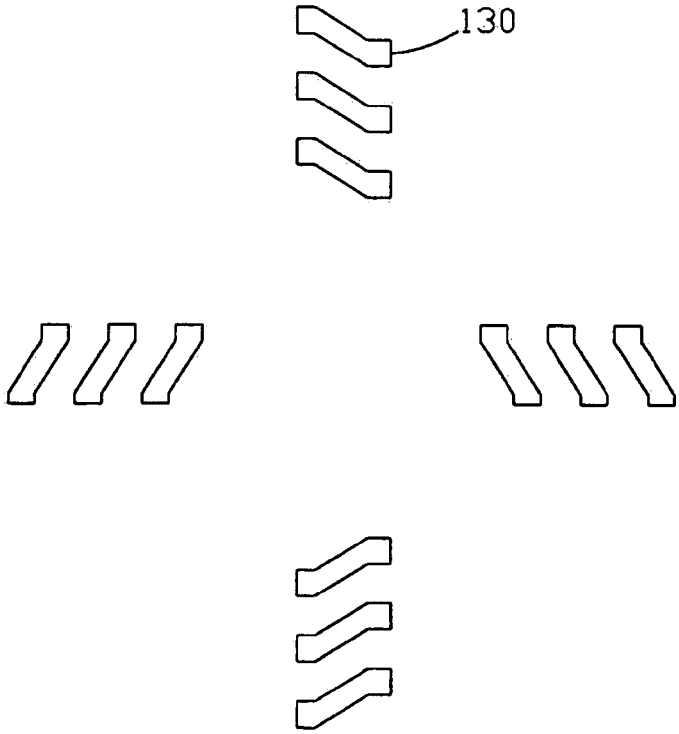
FIG.1B(Prior Art)
Figure 1C:
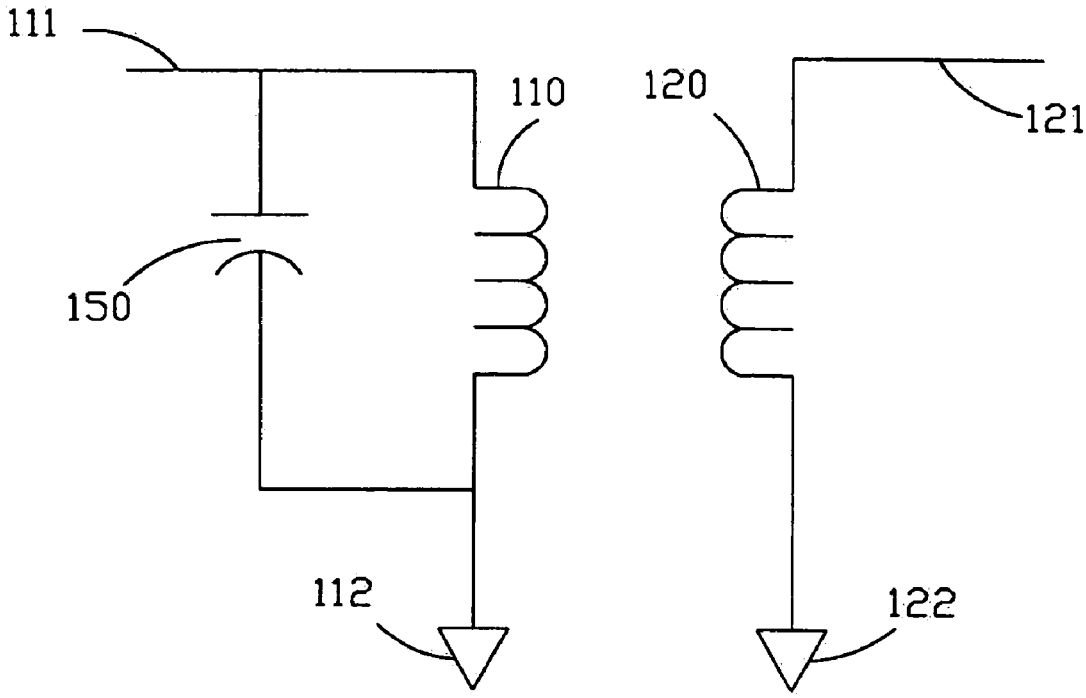
FIG.1C(Prior Art)
Figure 2A:
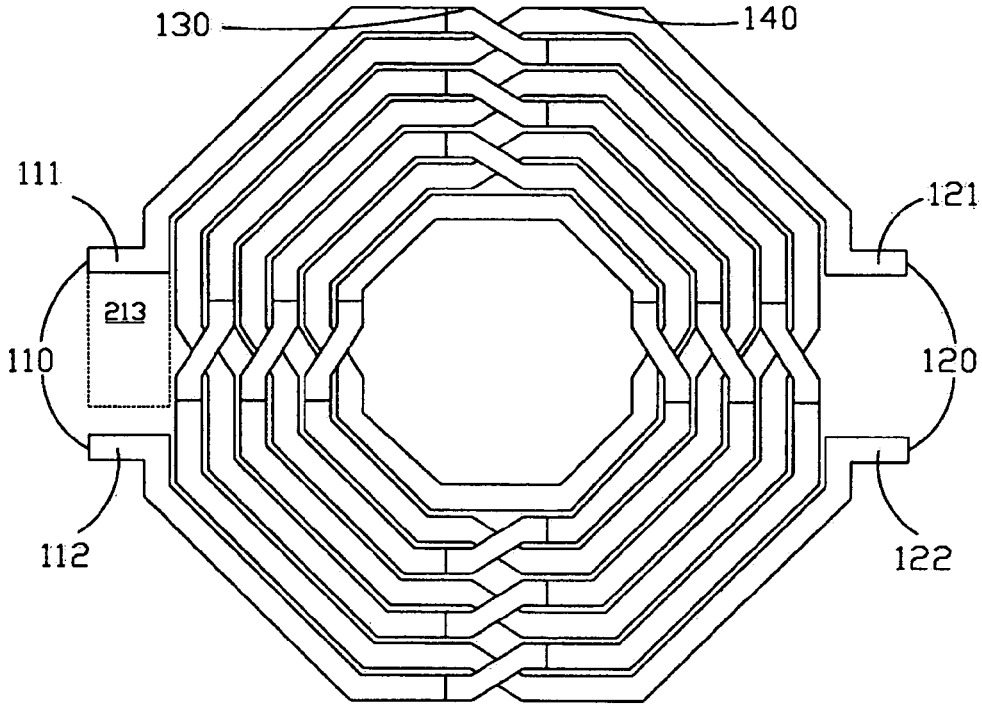
FIG. 2A and FIG. 2B are diagrams of a preferred embodiment of the present invention.
Figure 2B:
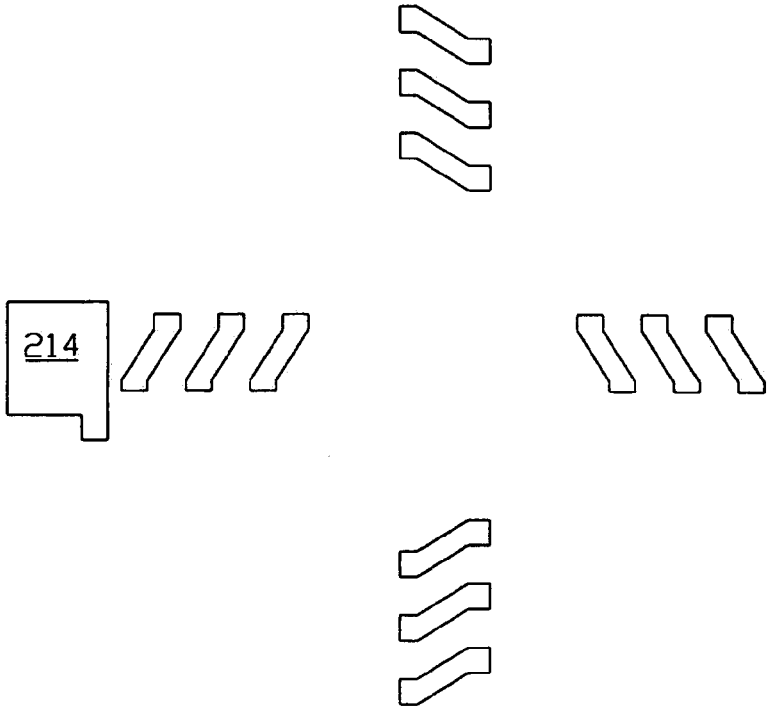

FIG. 2A and FIG. 2B are diagrams of a preferred embodiment of the present invention, in which the back of a coplanar transformer is shown. This transformer has primary coil 110 and secondary coil 120, end point 111 and end point 112 being end points of primary coil 110, and end point 121 and end point 122 being end points of secondary coil 120. Primary coil 110 and secondary coil 120 are respectively constituted by several conductor segments 140 and connected conductors 130, all conductor segments 140 being located at a first-metal layer and all connected conductors 130 being located at a second metal layer. Wherein, two ends of each connected conductor 130 are respectively electrically coupled with a conductor segment 140 to wind round a conductor segment 140 of another coil to prevent primary coil 110 and secondary coil 120 interleaved on the same plain from contacting with each other. Wherein an electrode plate 213 is extended from end point 111 to end point 112 at first metal layer as upper electrode plate of capacitor, and another electrode plate 214 located at second metal layer and electrically coupled with end point 112 in the opposite is considered lower plate to form a capacitor.

The capacitor said above can be generated at the same time with the whole coplanar transformer, using space between two end points 111 and 112 of primary coil 110 with the coplanar transformer to form upper plate of capacitor and using free space in relative position at second metal layer to form lower plate of capacitor. The merit of which is that the original structure of coplanar transformer needs not to be changed and that free space in coplanar transformer can be used.

Figure 3A:
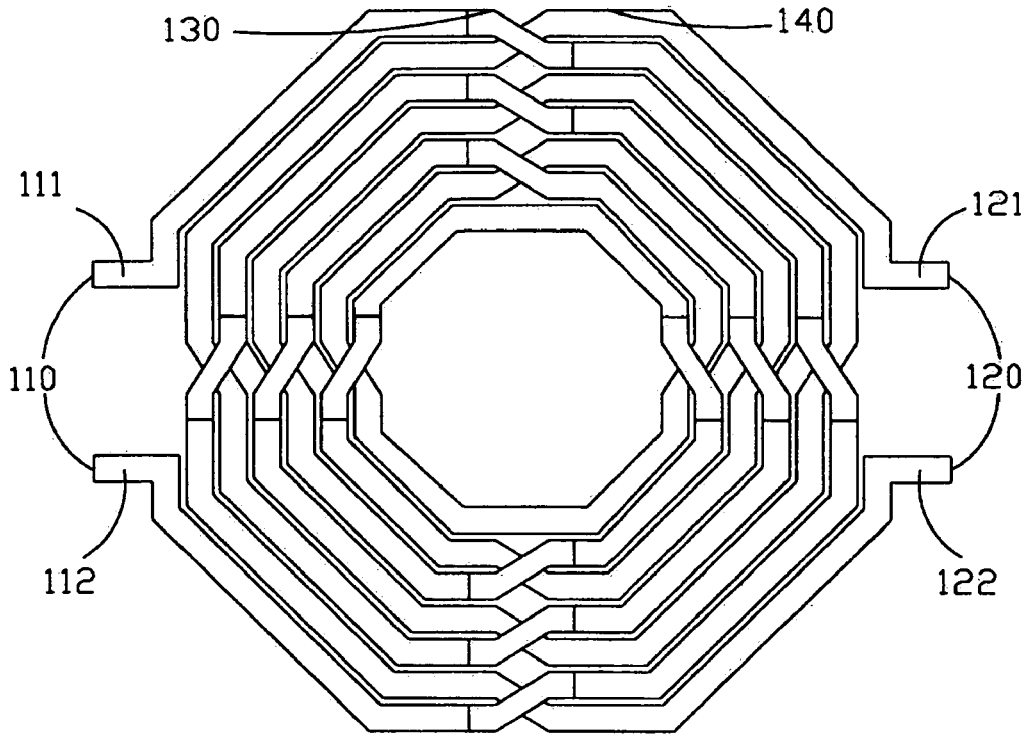
FIG. 3A and FIG. 3B are diagrams of another preferred embodiment of the present invention.
Figure 3B:
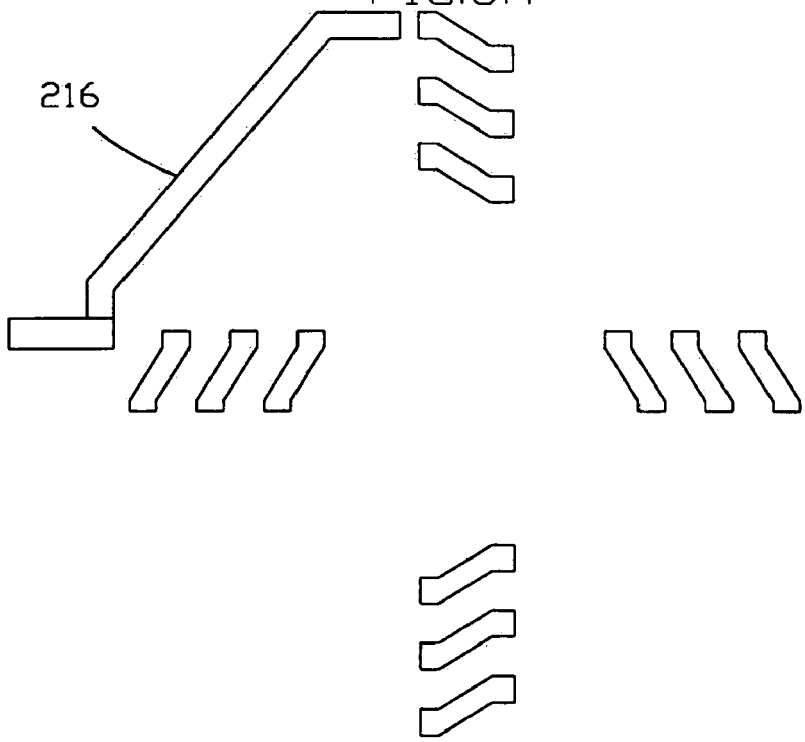

As shown in FIG. 3A and FIG. 3B, in another preferred embodiment in the present invention, conductor segment 140 connected with end point 110 of primary coil 110 is used as upper plate of capacitor and the corresponding electrode plate 216 in relative location at second metal layer is used as lower plate to form a capacitor. The electrode plate 216 is electrically coupled with end point 112, the scope of which ranging from the location at second metal layer opposite to end point 111, along conductor segment 140, and not reaching any of connected conductors 130.

Figure 4A:
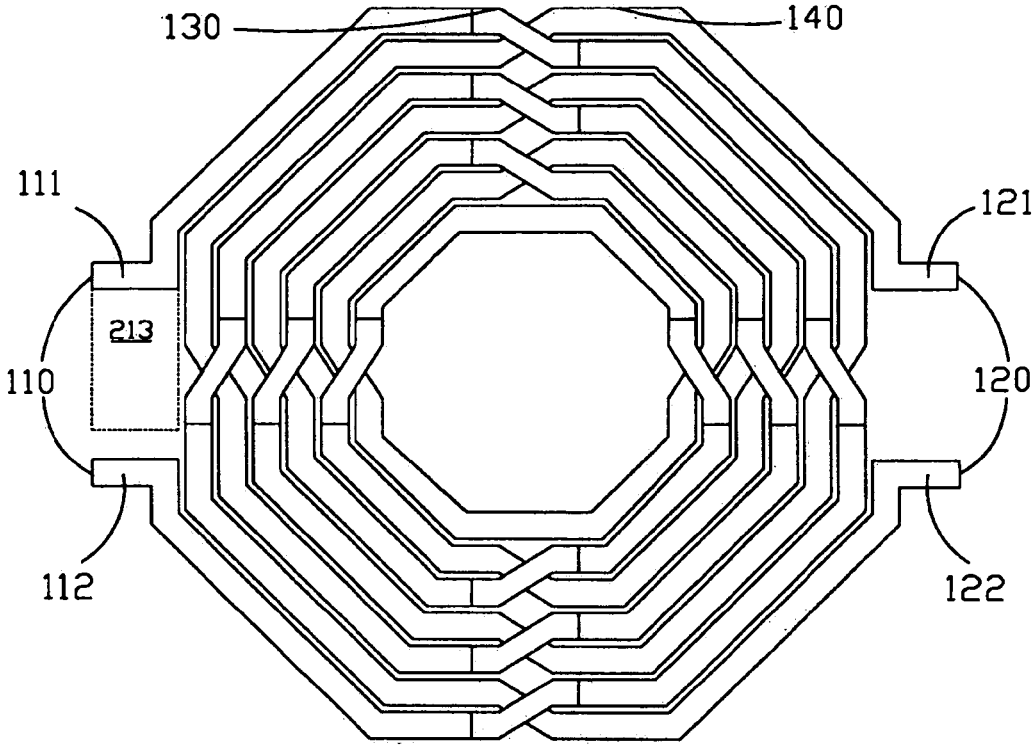
FIG. 4A and FIG. 4B are diagrams of still another preferred embodiment of the present invention.
Figure 4B:
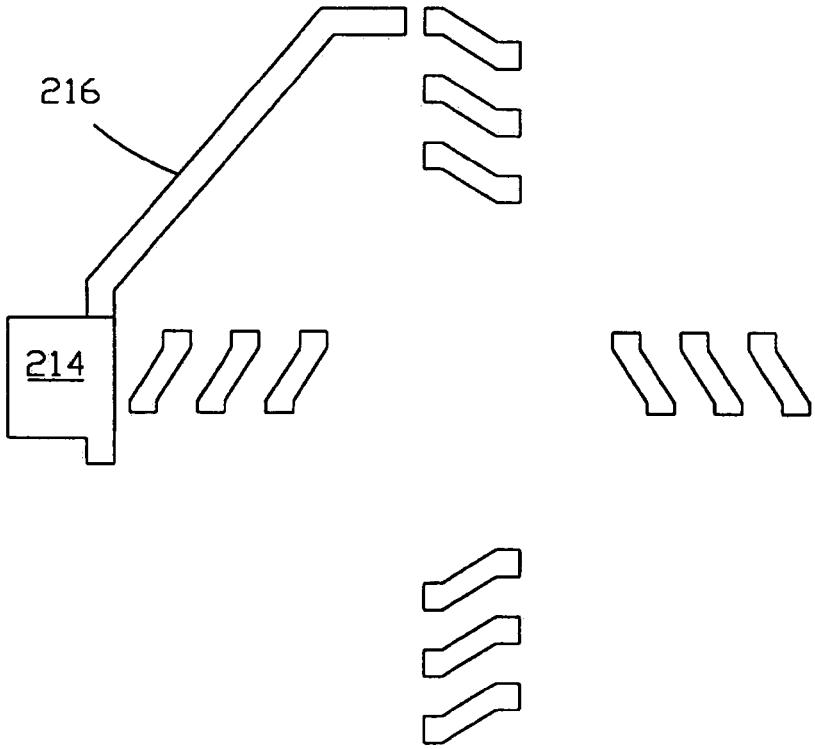

Therefore, still another preferred embodiment of the present invention is as shown in FIG. 4A and FIG. 4B, a coplanar transformer with a capacitor. The upper plate of the capacitor is constituted by an electrode plate 213 extending from end point 111 at first metal layer to end point 112 and conductor segment 140 connected with end point 110. Besides, the lower plate of the capacitor contains electrode plate 214 opposite to electrode plate 213 and electrode plate 216 opposite to conductor segment. The scope of electrode plate 216 opposite to conductor segment can range from position at second metal layer opposite to end point 111, along the conductor segment 140, and before reaching any of connected conductors 130.

According to this, a capacitor can be put in parallel connection with secondary coil 120 in the present invention, the way of embodying the capacitor being the same with the way of embodying the capacitor described in all other embodiments of the present invention and thus not being repeated. Therefore, the present invention can be a coplanar transformer, comprising a primary coil, a secondary coil, a first capacitor, and a second capacitor. Primary coil and secondary coil both contain two end points for inputting or outputting signal. Meantime, two end points of primary coil are respectively electrically coupled with upper plate and lower plate of first capacitor, and two end points of secondary coil are also respectively electrically coupled with upper plate and lower plate of second capacitor. Wherein, end point of primary coil and of secondary coil and upper plate are all located at a first metal layer, lower plate is located at second metal layer and its location is the opposite position of upper plate to lower plate, and upper plate and lower plate are in parallel. Besides, primary coil and secondary coil are interleaved at a plurality of interleaving sections, in which other parts of segments in primary coil and secondary coil become conductor segments. Wherein, in these interleaving sections, conductor of primary coil or secondary coil extends downward to the second metal layer to wind round the conductor of the other coil to prevent the two coils from crossing each other. Moreover, size of lower plate of first capacitor and of second capacitor is not limited in the present invention. The present invention can also be applied in non-interleaved coplanar transformer.

Furthermore, the present invention can be applied in integrated circuit structure. In this application, the present invention is a coplanar transformer integrated circuit structure, comprising a primary coil, a secondary coil, and an extra-coupled capacitor. Wherein, primary coil and secondary coil are interleaved up-and-down on an integrated circuit substrate, and said extra-coupled capacitor is located between the upper and lower layers of said integrated circuit substrate. Besides, said extra-coupled capacitor is achieved by using a parallel metal layer extra formed beyond an end point of said coils (primary coil or secondary coil).

What are described above are only preferred embodiments of the present invention, which are not used to limit the claims of the present invention; as for the above description, professionals that are familiar with the present technical field are able to understand and put into practice, and therefore, the equivalent changes or modifications made within the spirit disclosed by the present invention should be included in the appended claims.

What is claimed is:

1. A coplanar transformer, comprising:

a primary coil, said primary coil comprising a first end point and a second point located on a first metal layer;

a secondary coil, said secondary coil comprising a third end point and a fourth end point located on said first metal layer; and a first capacitor, said first capacitor comprising a first upper electrode plate located on said first metal layer and a first lower electrode plate located on a second metal layer, said first upper electrode plate and said first lower electrode plate being respectively electrically coupled with said first end point and said second end point.

2. The coplanar transformer according to claim 1, wherein said first lower electrode plate is located on the corresponding scope to said first upper electrode plate on said second metal layer.

3. The coplanar transformer according to claim 1, wherein between said first end point and said second end point comprises a space, and said first upper electrode comprises an electrode plate extending from said first end point toward said second end point and said first end point.

4. The coplanar transformer according to claim 1, wherein said first upper electrode plate comprises a first conductor segment in said primary coil connected with said first end point and said first end point.

5. The coplanar transformer according to claim 4, wherein said primary coil and said secondary coil are interleaved on a plurality of interleaving sections, said first conductor segment comprising the scope ranging from said first end point to one of said interleaving sections.

6. The coplanar transformer according to claim 1, wherein between said first end point and said second end point comprises a space, and said first upper electrode plate comprises an electrode plate extending from said first end point toward said second end point, said first end point, and a first conductor segment in said primary coil connected with said first end point.

7. The coplanar transformer according to claim 6, wherein said primary coil and said secondary coil are interleaved on a plurality of interleaving sections, said first conductor segment comprising the scope ranging from said first end point to one of said interleaving sections.

8. The coplanar transformer according to claim 1, wherein said coplanar transformer further comprises a second capacitor, said second capacitor comprising a second upper electrode plate located on said first metal layer and a second lower electrode plate located on a second metal layer, said second upper electrode plate and said second lower electrode plate being respectively electrically coupled with said third end point and said fourth end point.

9. The coplanar transformer according to claim 8, wherein said second lower electrode plate is located on the corresponding scope to said second upper electrode plate on said second metal layer.

10. The coplanar transformer according to claim 8, wherein between said third end point and said fourth end point comprises a space, and said second upper electrode comprises an electrode plate extending from said third end point toward said fourth end point and said third end point.

11. The coplanar transformer according to claim 8, wherein between said third end point and said fourth end point comprises a space, and said second upper electrode comprises an electrode plate extending from said third end point toward said fourth end point, said third end point, and a second conductor segment in said primary coil connected with said third end point.

12. The coplanar transformer according to claim 11, wherein said primary coil and said secondary coil are interleaved on a plurality of interleaving sections, said second conductor segment comprising the scope ranging from said third end point to one of said interleaving sections.

13. The coplanar transformer according to claim 1, wherein said second upper electrode plate comprises a second conductor segment in said primary coil connected with said third end point and said third end point.

14. The coplanar transformer according to claim 13, wherein said primary coil and said secondary coil are interleaved on a plurality of interleaving sections, said second conductor segment comprising the scope ranging from said third end point to one of said interleaving sections.

15. A coplanar transformer, comprising:

a primary coil, said primary coil comprising a first end point, a second end point, and a plurality of first conductor segments located on a first metal layer, and a plurality of first connected conductors located on a second metal layer, said first connected conductors being used to connect two of said first conductor segments;

a secondary coil, said secondary coil comprising a third end point, a fourth end point, and a plurality of second conductor segments located on said first metal layer, and a plurality of second connected conductors located on said second metal layer, wherein each of said second connected conductors being used to connect two of said second conductor segments; and a capacitor, said capacitor comprising a upper electrode plate located on said first metal layer and a lower electrode plate located on a second metal layer, said upper electrode plate and said lower electrode plate being respectively electrically coupled with said first end point and said second end point.

16. The coplanar transformer according to claim 15, wherein said lower electrode plate is located on the corresponding scope to said upper electrode plate on said second metal layer.

17. The coplanar transformer according to claim 15, wherein between said first end point and said second end point comprises a space, and said upper electrode comprises an electrode plate extending from said first end point toward said second end point and said first end point.

18. The coplanar transformer according to claim 15, wherein said upper electrode plate comprises said first conductor segment in said primary coil connected with said first end point and said first end point.

19. The coplanar transformer according to claim 15, wherein between said first end point and said second end point comprises a space, and said upper electrode plate comprises an electrode plate extending from said first end point toward said second end point, said first end point, and said first conductor segment in said primary coil connected with said first end point.

* * * * *